United States Patent [19]

Vidakovic et al.

[11] 4,066,047

[45] Jan. 3, 1978

[54] TOROIDAL HEAT EXCHANGER HAVING A HYDRAULIC FAN DRIVE MOTOR

[75] Inventors: Aleksandar Vidakovic, Libertyville; Stanley Urman, Waukegan; Donald F. Rudny, Mundelein, all of Ill.

[73] Assignee: International Harvester Company, Chicago, Ill.

[21] Appl. No.: 678,266

[22] Filed: Apr. 19, 1976

[51] Int. Cl.[2] ..... F01P 7/02; F01P 11/08

[52] U.S. Cl. ..... 123/41.12; 123/41.33; 123/41.49; 123/41.51; 123/41.57; 165/125

[58] Field of Search ..... 123/41.49, 41.65, 41.33, 123/41.51, 41.57, 41.12; 165/125

[56] References Cited

U.S. PATENT DOCUMENTS

| | | | |
|---|---|---|---|
| 1,872,785 | 8/1932 | Modine | 165/125 |
| 1,893,650 | 1/1933 | Modine | 165/125 |
| 2,295,991 | 9/1942 | Goldthwaite | 165/125 |
| 2,301,818 | 11/1942 | Sackett | 165/125 |
| 2,362,955 | 11/1944 | Cantwell | 165/125 |
| 2,370,309 | 2/1945 | Hartwig | 165/125 |
| 2,814,467 | 11/1957 | Brinen | 165/125 |
| 2,863,645 | 12/1958 | Spieth | 165/125 |
| 3,217,697 | 11/1965 | Mayr | 123/41.49 |
| 3,659,567 | 5/1972 | Murray | 123/41.49 |
| 3,978,919 | 9/1976 | Fachbach | 165/125 |

*Primary Examiner*—Ronald H. Lazarus
*Assistant Examiner*—Daniel J. O'Connor
*Attorney, Agent, or Firm*—Douglas W. Rudy; Floyd B. Harman

[57] ABSTRACT

A toroidal heat exchanger incorporates an air flow directing support cone housing a hydraulic motor used for driving an air propelling means at variable speeds depending on the cooling requirements of the host vehicle.

6 Claims, 4 Drawing Figures

TOROIDAL HEAT EXCHANGER HAVING A HYDRAULIC FAN DRIVE MOTOR

BACKGROUND OF THE INVENTION

1. Field of the Invention

This invention relates to a support cone being truncated to a frustum for use inside a toroidal heat exchanger. The support cone directs air flow through the heat exchanger and also presents a mounting location for a hydraulic fan driving motor which is responsive to engine cooling requirements.

2. Description of the Prior Art

The use of static toroidal or annular heat exchangers are being contemplated for a broad range of applications due to the inherent efficiency of this type of heat exchanger. Compared with the flat, slab, or plinth type heat exchanger constructions the static toroidal units have several capacity and efficiency advantages. For instance, when a rectangular plinth type radiator is used a circular fan cannot pull or push an even and consistent flow of air through the heat exchanger core. Generally, the air is presented to the heat exchanger on a relatively circular area thus the corners of the heat exchanger don't receive the amount of air flow that the central sections receive. Also the fan usually is destined to operate at a reduced efficiency level due to the lack of lateral space necessary to install an efficient flow improving fan shroud in a typical vehicle embodiment. Air flow through the toroidal or annular heat exchanger is propagated by the use of either a "pusher" or alternatively by a "sucker" type fan. As this fan is generally mounted at one annular opening of the toroidal heat exchanger the flow of air in respect to volume and velocity, through each stratum of the heat exchanger may vary. In other words, air flow through the radial passages of the heat exchanger at remote stratum areas could be less than air flow through the heat exchanger in the middle of the radial air passages.

In order to improve flow to areas at the remote, distant or extreme portions of the heat exchanger this invention presents an interior shroud or more properly a support cone truncated to a conical frustum to direct air in an efficient manner. This support cone in a basic embodiment is generally conical with the truncated reduced diameter portion in proximity to the mounted fan. The truncation plane acts as a mounting surface to accommodate a hydraulic motor mounted inside the support cone.

This invention contemplates the use of a variable speed hydraulic motor which is responsive to an engine coolant temperature sensing control system capable of allowing the fan driving hydraulic motor to be run at a speed related to the amount of engine cooling required.

A toroidal or static annular heat exchanger as contemplated for use with the proposed system is known in the prior art. The known devices, however, use conventional fan drive systems and are not provided with flow improving internal shrouds. Also shown in the prior art is a hydraulically driven fan driving means responsive to engine coolant temperature. This embodiment shows a flat radiator and only a rudimentary conventional shrouding. The main emphasis is focused more to the devices necessary to prevent hydraulic fluid being preferentially pumped to the fan motor when the fluid is more critically needed by other hydraulic systems.

One of the significant contributions of this invention over the prior art is the use of the support cone to improve the air flow to the heat exchanger core while at the same time providing a mounting location for a variable speed hydraulic motor to drive the fan.

SUMMARY OF THE INVENTION

Where a toroidal shaped heat exchanger is used to provide cooling capability for a vehicle it has been found that it is beneficial to provide an interior shroud to improve air flow through the heat exchanger. The interior shroud or support cone of this invention provides improved air flow while also providing a mounting means for a hydraulically driven fan drive motor that is in close proximity to a fan thus eliminating the usual long unsuspended fan drive axle.

Also contemplated in this invention is a system to regulate the speed of the hydraulic motor used to drive the fan through the use of an engine coolant temperature responsive hydraulic fluid supply system that regulates the amount of fluid flow to the hydraulic motor thus regulating the speed of the fan as necessary to provide adequate heat transfer from the engine coolant as the coolant passes through the radiator.

Not only would the hydraulic fan drive motor be capable of being varied depending on the state of the engine but also it would not drive the fan at all until the engine temperature reached a predetermined temperature.

The use of a toroidal heat exchanger with the modulated hydraulic fan motor would also be quieter in operation than a comparable constant drive fan and a conventional heat exchanger matrix. It would not be running full time, or more realistically, it would be running slower more often than the constant driven type.

Another advantage of this type of heat exchanger and fan drive is the expected increase in fuel economy. It is well known that a fan draws a significant amount of horsepower. If this horsepower draw can be decreased it is axiomatic that the fuel consumption of the vehicle will decrease or alternatively the horsepower available to drive the vehicle will increase thus making the vehicle more efficient.

Various other advantages will be apparent from the following description of one embodiment of the invention, and novel features will be particularly pointed out hereinafter in connection with the appended claims.

BRIEF DESCRIPTION OF THE DRAWINGS

The invention is embodied as set out in the following explanatory drawings in which.

DETAILED DESCRIPTION OF THE INVENTION

Looking at the figures in detail various relationships of the components can be ascertained. In the individual figures like components are assigned like reference numbers.

Figure 1:
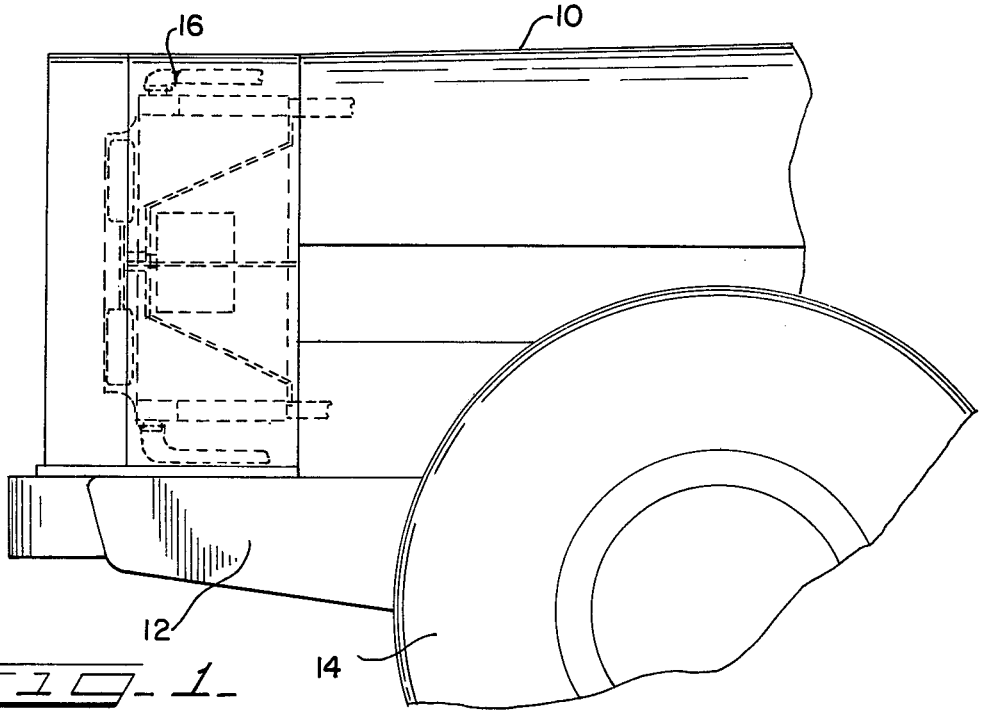
FIG. 1 presents an elevation view of an end of a vehicle showing the toroidal heat exchanger and the attendant motor, fan and support cone in a broken line view.

FIG. 1 shows a portion of a vehicle 10, which may be the engine portion of an articulated loader, for instance. It alternatively could represent the engine portion of another type of large earth moving vehicle such as a dump truck, a mobile crane, a scraper, or a grader. The vehicle would normally have a frame 12 which would be supported by an axle (not shown) through wheel and tire assembly 14. Shown in the broken line view of FIG. 1 is the toroidal heat exchanger assembly, generally 16. The toroidal heat exchanger assembly is presented in more detail in FIGS. 2 and 3 discussed below.

Figure 3:
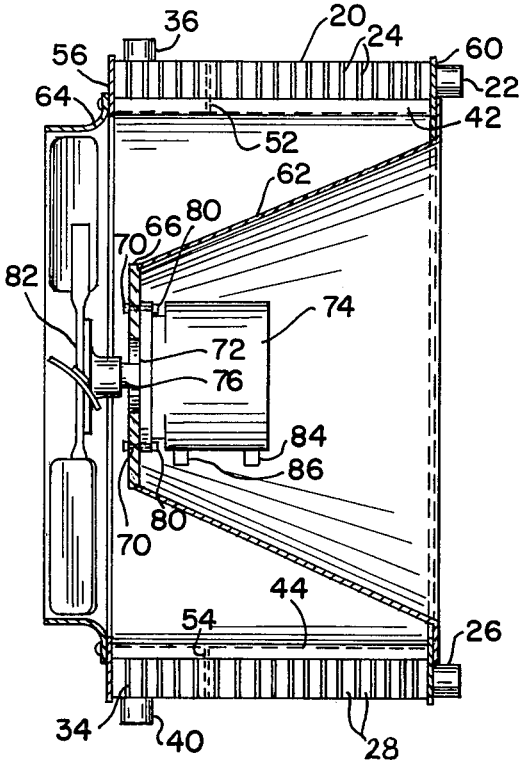
FIG. 3 is a cross sectional view of the heat exchanger as taken through plane 3—3 of FIG. 2.
Figure 2:
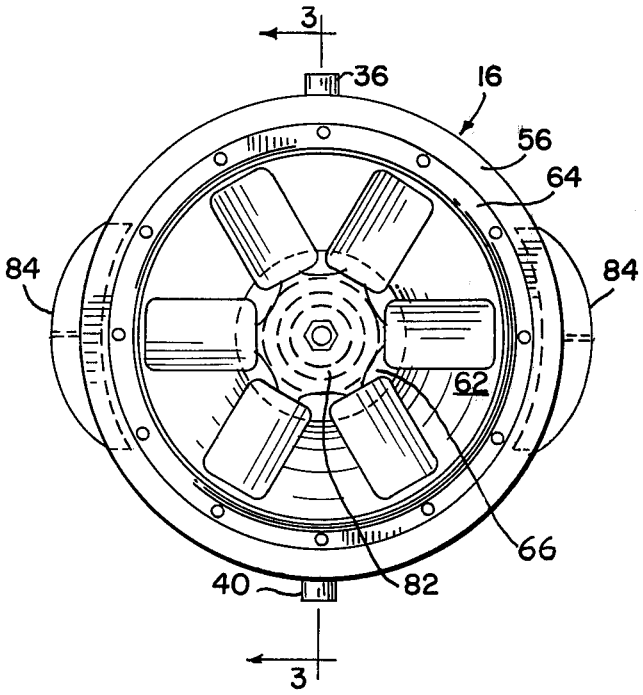
FIG. 2 is a front view of the toroidal heat exchanger assembly of the invention.

Looking first at FIG. 3 a cross sectional view of FIG. 2 through plane 3—3 is presented. The toroidal heat exchanger 20 is of a multi-chamber design allowing the cooling of several types of fluid simultaneously. For instance, engine cooling fluid such as water or permanent antifreeze would be supplied to the heat exchanger via inlet 22 to an inlet header tank 42 which would distribute the cooling fluid to core elements 24.

The core elements 24 would comprise a plurality of fluid passages which are connected at one end to the inlet chamber or an inlet header tank 42 and at the other end to an outlet chamber or outlet header tank 44 at the bottom of the toroidal heat exchanger to provide a passage from the inlet header tank 42 to the outlet header tank 44. The core elements 24 could be spaced apart to allow air flow to pass over the maximized heat transfer surface and cool the fluid passing through the core elements 24. The cooling fluid would be circulated through the core elements which make up approximately 75% of the heat exchanger structure before being passed out of the heat exchanger from cooling fluid outlet 26.

A second annular ring section 34 of the toroidal heat exchanger, filled through second inlet 36 may be used for cooling the hydraulic operating fluids of the host vehicle. Fluid would then pass out of this second section via outlet 40. A portion of the inlet chambered header tank 42 and a portion of the outlet chambered header tank 44 is partially shown in FIG. 3. Upper and lower partitions 52 and 54, respectively, (shown in broken lines) separate the cooling fluid chamber from the second chamber in this example.

A toroidal heat exchanger having capacity for two types of fluid is shown, however, it is known that heat exchangers having the capacity of passing three types of fluid are available. The number of fluid chambers in a heat exchanger is not important to this invention and it should be understood that the invention should not be limited to a two chamber unit. Single or multiple chamber heat exchangers are contemplated.

Similarly the heat exchanger is referred to as a toroidal heat exchanger. This term is used to indicate that the cross sectional shape of the heat exchanger core could be rectangular as shown or square, polygonal, arcuate, circular, eliptical or any other shape deemed apropos. The cross sectional shape of the heat exchanger core section is not critical to the concept of this invention.

A front wall 56 and a rear wall 60 act as structural support members. The rear wall 60 in combination with the interior shroud 62 effectively prevents air flow out the back of the toroidal heat exchanger. The front wall 56 is a flat ring which acts as a mounting plate for an external fan shroud 64. This fan shroud may be of a conventional type or of a flow improving type that will assist in the efficient direction of air flow through the toroidal heat exchanger.

The support cone 62 is carried by the back wall 60 of the toridal heat exchanger. It may be welded, bolted or otherwise fastened to the back wall as appropriate. FIG. 3 clearly shows the conical frustum shaped contemplated for use in the application of this invention. The forward truncated part of the support cone 62 is closed by a mounting plate 66 which is equipped with mounting holes 70 and shaft accommodating aperture 72. A variable speed hydraulic motor 74 having an output shaft 76 is mounted to the inner side of the mounting plate 66 by fasteners such as 80 as shown in FIG. 3. The output shaft 76 passes through the aperture 72 and accommodates a fan 82 of a conventional propeller type. The hydraulic motor may have inlet and outlet ports 84 and 86 respectively to which hydraulic fluid will be supplied to drive the motor.

FIG. 2 presents many of the components described in connection with FIG. 3 in an elevation view. Clearly shown are the front wall 56 of the toroidal heat exchanger assembly generally 16 and the fan shroud 64 affixed to the front wall by fasteners. Also seen are the fan 82, the mounting plate 66, the support cone 62, the second inlet 36 and the second outlet 40. A pair of mounting tabs 84 are also shown in FIG. 2. These mounting tabs provide additional mounting means for attaching the toroidal heat exchanger assembly to a host vehicle.

Figure 4:
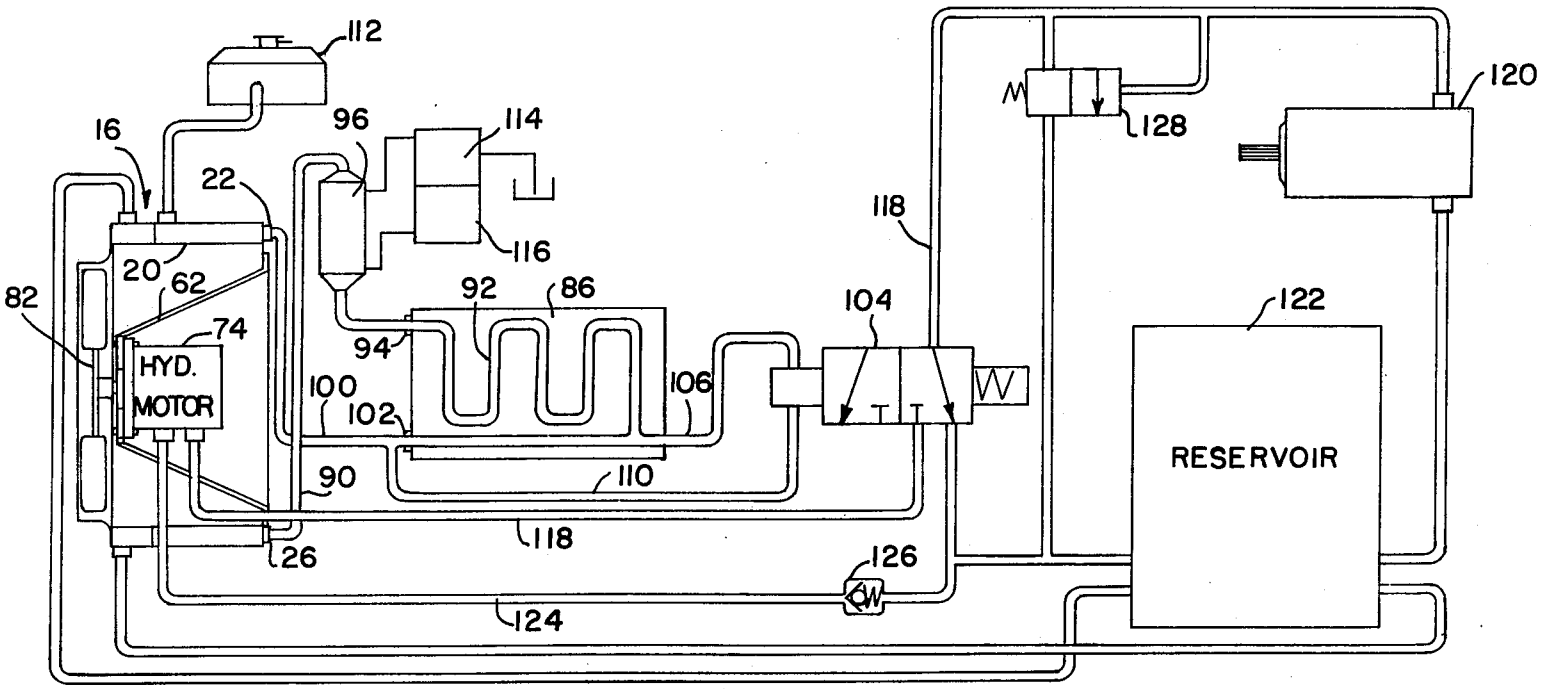
FIG. 4 is a schematic presentation showing the hydraulic system of the invention in its interfacing relationship with the engine cooling system.

Looking at FIG. 4 the toroidal heat exchanger assembly is shown in a scehmatic presentation of its operating environment. The heat exchanger assembly, generally 16, is associated with the vehicle engine 86 by means of a coolant supply conduit 90 connected at one end to the outlet fitting 26 and to the engine water jacket 92 at its inlet 94. A small heat exchanger 96 is used as a torque converter fluid and transmission fluid cooler. The coolant which circulates through the engine is delivered to the toroidal heat exchanger by conduit 100 connected to the engine water jacket at fitting 102 and to the heat exchanger at inlet 22. In order to assure the flow of coolant through the engine coolant system a water pump (not shown) may be used.

To regulate the heat transferring effect on the cooling fluid passing first through the engine and thence through the heat exchanger a spool valve 104 responsive to and operatively indexed to the temperature of the engine coolant is used. the valve is conventional. It is composed of two systems, one system is a temperature sensing system and the second is a spool valve that meters the flow of hydraulic fluid passing through it. The temperature sensing portion receives input from the engine coolant. If the coolant is below a preset temperature, the spool portion of the valve remains closed. As the temperature of the engine coolant is raised the temperature responsive portion of the valve will cause the spool portion of the valve to open. The amount of hydraulic fluid passing through the valve is proportional to the temperature of the engine coolant. Thus when the coolant is hot a substantial quantity of fluid will pass to the hydraulic motor to drive the fan at a high rate of speed. With a moderate engine coolant temperature only a moderate amount of hydraulic fluid will be allowed to the hydraulic fan drive motor and the fan will be driven in a moderate speed.

Heated coolant is supplied to the spool valve 104 from the water jacket system as by conduit 106 and this coolant, after passing via conduit 110, joins heated coolant going to the toroidal heat exchanger in conduit 100.

A final element of the coolant system is the expansion tank 112 which serves as a make-up supply reservoir as well as an expansion tank.

The small heat exchanger 96 may be connected by conduits, as shown, to a source of transmission fluid 114 and a source of torque converter fluid 116 to provide cooling of these fluids as they pass through the small heat exchanger.

The hydraulic motor 74 is mounted to the interior of the support cone 62 inside the toroidal heat exchanger 20. Fluid to drive the motor is provided through conduit 118 when the spool valve 104 is displaced responsive to the engine coolant temperature. A hydraulic pump 120, which may be driven by the vehicle engine, draws the fluid from the reservoir 122 through conduits provided. Fluid passes out of the hydraulic motor 74 through conduit 124 to the reservoir 122 when the motor is being driven.

When the heat responsive spool valve 104 has closed, as shown in FIG. 4, preventing the flow of hydraulic fluid from the pump 120 to the motor 74, fluid from the pump will pass directly to the reservoir. Check valve 126 in conduit 124 will insure that the motor will not receive the pressure of the pump on the outlet side thereof.

A pressure relief valve 128 protects the motor 74 from excessive high pressure by allowing fluid flow to pass from the pump 120 to the reservoir 122 when pressure from the pump exceeds the design setting of the relief valve 128.

A fluid circuit may be provided for the reservoir 122 to the second section of the toroidal heat exchanger in order to provide cooling to the hydraulic fluid as deemed necessary. The pump to initiate this flow is not shown.

The cooling system as shown is simply an example of the interfacing relationship between coolant temperature and the driving speed of the fan driving motor.

The regulation of the fan driving motor is such that the valve 104 will provide just enough fluid to drive the motor and thus the fan 82 at a speed commensurate with the need of dissapating heat in the toroidal heat exchanger. Thus when the engine is cold the fan will not be driven at all. This aids in rapidly building heat in the engine to normal operating temperature. As the engine heat increases the hydraulic motor will begin to drive the fan at a slow rate just sufficient to cool the engine coolant to the optimum temperature. Of course when the engine coolant reaches a very hot predetermined temperature the fan will be driven constantly at a high rate of speed.

The ability to have a coolant temperature control system that can control the temperature of the coolant flowing through an engine is universally desired as all engines operate at optimum temperature efficiency in a specific range. Historically this has been provided by a thermostat generally located in the engine block proper that would allow fluid to flow from the vehicle heat exchanger or vehicle radiator into the engine block. This thermostat is responsive to the engine coolant temperature and when the engine temperature drops below a predetermined point the thermostat will close cutting off flow of fluid from the engine to the radiator or heat exchanger. The disadvantage of this type of system is that the fan 82 providing air flow through the heat exchanger 20 is continually driven by the vehicle engine. This of course draws a considerable amount of horsepower from the engine. This horsepower could be used more effectively for driving the vehicle rather than for driving the fan which is not used when the engine is cold.

One of the more specific advantages that is presented in this invention involves the support cone 62. In this invention the support cone 62 serves a two fold purpose. The first being that it is a structurally sound mounting convenience to accommodate the hydraulic motor 74. The second advantage is that the support cone 62 improves the flow of air flow from the fan 82 through the core elements 24 (FIG. 3) of the heat exchanger 20. The flow of air is improved whether the fan is operating as a "pusher" fan pushing the air into the interior section between the surface of the support cone and the heat exchanger and out through the core or whether the fan is operating as a sucker drawing air through the core thence through the space between the core and the support cone. The support cone provides an impinging surface which directs air flow. The fan 82 could be pushing air into the interior of the heat exchanger or it could be driving air out of the heat exchanger depending on design preferences.

It has been found that without this type of interior structure, namely the support cone, it is difficult to insure that an even and adequate flow will be maintained across the full width of the radiator core. However, with the support core in place it is much more probable that even flow will exist across the entire surface of the core of the heat exchanger. A rudimentary frustum is shown, however, it is obvious that this shape would not be optimum for all conditions of fans and heat exchangers. Consequently it is expected that the frustum or support cone shown could be modified to be more effective and still be within the scope of this invention. The most obvious modification to the support cone would be to revise the slope of the cone such that the slope would vary from the top portion or truncated portion of the cone to the base. This would allow a distribution of air flow through adjacent core elements in an efficient manner.

Although the support cone as shown shows a true conical shape the truncated upper portion the cone shape could be modified to have a less angular and more curved shape to present to the flow of air.

A further advantage of having the heat exchanger fan being driven by a hydraulic pump is that the heat exchanger and the fan can be mounted in a location most advantageous to the layout of the vehicle. The mounted location shown in FIG. 1 is not the only place that the heat exchanger assembly could be mounted. For instance, the assembly could be mounted to the forward portion of the vehicle or alternatively on top, below, or on the side of the vehicle. By being able to mount the heat exchanger and its drive remotely from the engine it is also possible that an effective noise baffling enclosure could be constructed around the engine. These advantages are significant in light of impending environmental quality statutes as well as opening new design and layout options for the placement of the heat exchanger in vehicles of various types.

Thus it is apparent that there has been provided in accordance with the invention a toroidal heat exchanger having a hydraulic fan drive motor that fully satisfies the objects, aims, and advantages set forth above. While the invention has been described in conjunction with the specific embodiments thereof it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a vehicle having an engine means generating a plurality of heated fluids an apparatus for affecting the heat content of said fluids, said apparatus comprising:

a toroidal heat exchanger having a plurality of annular ring sections, each section having an inlet header tank and an outlet header tank equipped with respective inlet and outlet ports and a plurality of core elements connecting respective inlet and outlet header tanks allowing fluid passage from the inlet header tanks to the outlet header tanks;

conduit means connecting said inlet and outlet header tanks to fluid sources of said engine for allowing fluid communication between said engine and said toroidal heat exchanger;

one of said fluid sources being an engine cooling fluid and at least one of hydraulic operating fluid and lubricating fluid;

a support cone being truncated above the base thereof to form a conical frustrum located in the interior portion of the toroidal heat exchanger surrounded by said core elements thereof, the truncated portion of the support cone covered with a plate having a plurality of apertures therein;

a hydraulic motor having an output shaft, said motor affixed to said plate of said support cone, said output shaft projecting through an aperture in said plate, the hydraulic motor located completely inside said support cone;

a fan having multiple blades carried on said hydraulic motor shaft, said fan blades being positioned outboard of said annular ring sections of said toroidal heat exchanger;

a source of pressurized hydraulic fluid for driving said hydraulic motor;

hydraulic fluid conduit allowing fluid communication between said source of pressurized hydraulic fluid and said hydraulic motor;

a normally closed temperature responsive spool valve for controlling hydraulic fluid flow to said hydraulic motor from said source of hydraulic fluid interposed between said hydraulic fluid source and said hydraulic motor;

conduit means allowing communication of heat fluid from said engine to said temperature responsive spool valve whereby said temperature responsive spool valve is caused to open such that said hydraulic motor receives hydraulic fluid from said source of hydraulic fluid in response to the displacement of said spool valve.

2. The invention in accordance with claim 1 wherein said support cone further comprises an aperture equipped mounting collar extending outwardly from the base of said support cone whereby said cone is mounted to said toroidal heat exchanger.

3. The invention in accordance with claim 1 wherein the slope of the support cone is not constant throughout the height of the support cone.

4. The invention in accordance with claim 3 wherein the support cone is truncated by a plane passing through the cone perpendicular to the major axis thereof.

5. The invention in accordance with claim 1 wherein the support cone is truncated by a plane passing through the cone perpendicular to the major axis thereof.

6. The invention in accordance with claim 1 wherein the support cone has a height corresponding to the depth of the toroidal heat exchanger.

* * * * *